US005597404A

United States Patent [19]

Domergue et al.

[11] Patent Number: 5,597,404

[45] Date of Patent: Jan. 28, 1997

[54] APPARATUS FOR PROCESSING A PRODUCT FROM CATALYTIC REFORMING

[75] Inventors: Bruno Domergue; Beatrtice Fischer, both of Rueil Malmaison; Larry Mank, Orgeval, all of France

[73] Assignee: Institut Francais Du Petrole, France

[21] Appl. No.: 466,686

[22] Filed: Jun. 6, 1995

Related U.S. Application Data

[62] Division of Ser. No. 271,466, Jul. 7, 1994, abandoned.

[30] Foreign Application Priority Data

Jul. 8, 1993 [FR] France ..... 93/08413

[51] Int. Cl.[6] ..... B01D 53/04; B01D 53/14

[52] U.S. Cl. ..... 96/134; 96/136; 96/142; 96/201

[58] Field of Search ..... 95/204, 246, 247, 95/258; 96/134, 136, 142, 193, 201

[56] References Cited

U.S. PATENT DOCUMENTS

| | | | |
|---|---|---|---|
| 2,847,361 | 8/1958 | Hengstebeck | 96/201 X |
| 2,937,140 | 5/1960 | Stinson | 96/193 X |
| 3,179,500 | 4/1965 | Bowen et al. | 96/136 X |
| 3,520,800 | 7/1970 | Forbes | 208/101 |
| 4,374,726 | 2/1983 | Schmelzer et al. | 208/101 |
| 4,531,070 | 7/1985 | Kuhn | 96/136 X |

FOREIGN PATENT DOCUMENTS

| | | |
|---|---|---|
| 0002171 | 12/1981 | European Pat. Off. . |
| 0233956 | 12/1989 | European Pat. Off. . |

OTHER PUBLICATIONS

Chem. Abs., vol. 113, No. 18, Oct. 29, 1980.

*Primary Examiner*—Robert Spitzer

[57] ABSTRACT

Apparatus for conducting an improved method of processing a catalytic reformate with an improved production of hydrogen. The apparatus comprises units for conducting a separation stage, absorption at 20° to 60° C. and at a pressure of at least 10 bars, purification of hydrogen over adsorbent beds and recycling of the residual gas obtained at purification.

2 Claims, 2 Drawing Sheets

1
2
3
4
5
6
7
11
20
21
22
23
24
25
26
27
28
29
30
31
32
33
P
R
E
G
GR
H2

APPARATUS FOR PROCESSING A PRODUCT FROM CATALYTIC REFORMING

This is a division of application Ser. No. 08/271,466 filed Jul. 7, 1994, now abandoned.

BACKGROUND OF THE INVENTION

The invention relates to an apparatus for processing the hydrocarbon product obtained from a catalytic reforming reaction.

This reaction generally takes place in at least one reforming reactor in the presence of a catalyst and under suitable working conditions. The product emerging from the final reactor may be cooled or subjected to other treatments before being passed to the reformate separation process and the production of hydrogen.

BRIEF DESCRIPTION OF DRAWINGS

The prior art known to the inventors is illustrated schematically by FIG. 1, whereas

DETAILED DESCRIPTION OF FIG. 1

Figure 1:
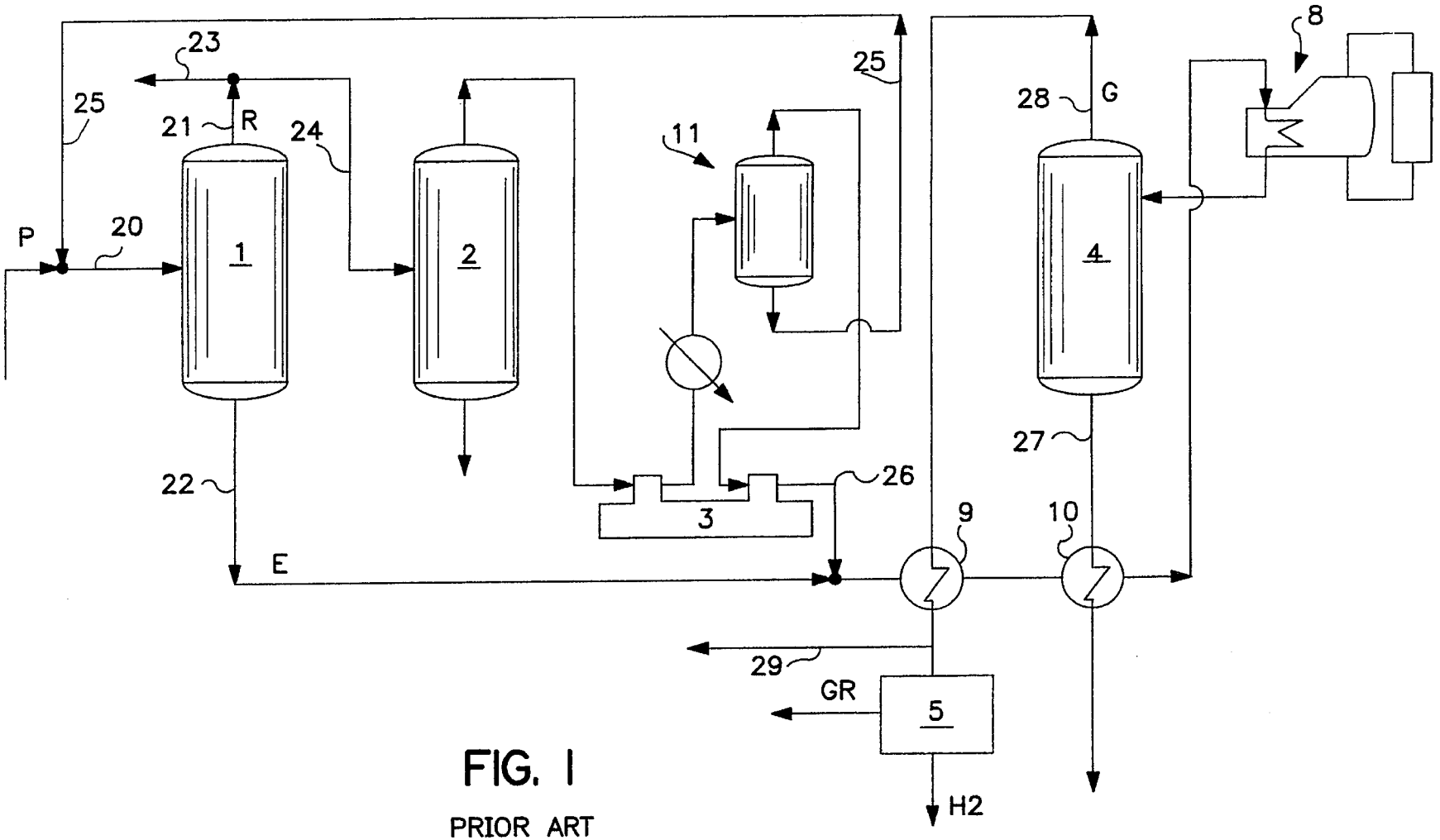
FIG. 1 PRIOR ART

Referring to FIG. I, the product P emanating from the reforming reaction (including having undergone various treatments) is introduced (duct 20) into a separator 1 for separating the product into a hydrogen rich gaseous phase R (duct 21) on the one hand and a liquid effluent E (duct 22) on the other.

The low pressure gaseous phase R is in part recycled to the reforming reaction (duct 23). The other part is directed (duct 24) to a compressor 3 generally via a storage flask 2. Shown here is a two-stage compressor with an inter-stage flask 11. The compressed phase (down to at least 10 bars) obtained is introduced into the effluent E (duct 26). The liquid phase produced during intermediate cooling is recycled to the separation stage (duct 25).

The biphase mixture of effluent E and compressed gaseous phase is cooled to less than 5° C. (and generally between −25° C. and 0° C.) before being introduced into the recontactor (or absorber) 4.

The temperature is lowered by heat exchange with the products emerging from the absorber, that is to say with the gas G through the exchanger 9 and with the liquid reformate through the exchanger 10. In the event of this lowering of temperature not being adequate, a cooling system 8 has to be installed.

The absorber 4 functions under a pressure of at least 10 bars and at less than 5° C., it makes it possible to separate the phases and to collect the reformate (duct 27) and the gas G (duct 28), the hydrogen purity of which is 93 to 95%. A part of this gas G may advantageously be directed (duct 29) to a hydroprocessing unit, particularly for the reforming batch. This gas then passes into a purifying assembly 5 to produce high purity hydrogen (at least 99 and preferably 99.9%). The residual gas GR emerging is rejected outside the plant and it is generally burned.

Such processes make it possible to produce very pure hydrogen particularly for supplying the hydrocracking unit situated downstream of the reforming stage and 93 to 95% pure hydrogen for the hydroprocessing plant on the upstream side.

The inventors have found that with these processes only about 85% of the hydrogen produced by reforming was recovered.

SUMMARY OF THE INVENTION

The present invention proposes apparatus for conducting a method which makes it possible to recover nearly 95% (and even more) of the hydrogen theoretically produced at the reforming stage, the said process being based on recycling at substantially constant pressure the residual gas preferably accompanied by a change in the working conditions of recontacting.

More precisely, the subject-matter of the invention is a method of processing the product emanating from a catalytic reforming reaction of a hydrocarbon change, comprising:

- separation of the product P of reforming into a hydrogen rich gaseous phase R and an effluent E,
- recycling of a part of the gaseous phase R obtained at separation and passing it to the reforming reaction,
- a compression of the other part of the said gaseous phase R to a pressure of at least 10 bars,
- recontacting of the said effluent E with the compressed gaseous phase R under conditions which make it possible to obtain a gas which is enriched in hydrogen and a liquid phase which is enriched in reformate,
- a purification of the said gas G in order to obtain hydrogen of better than 99% purity and a residual gas GR, in which process the residual gas GR is in part at least recycled in the gaseous phase which is subjected to compression, recycling being carried out at a substantially constant pressure, the other part of the residual gas which is not recycled being rejected.

Preferably, the effluent E and the compressed gaseous phase are recontacted at a pressure comprised between 10 and 50 bars, a temperature comprised between 20° and 60° C. in order to obtain a gas G with a hydrogen purity at least equal to 95%.

The plant for carrying out this method comprises:

- a separator provided with an inlet duct for product P emanating from the reforming reactor, a duct for drawing off a hydrogen rich gaseous phase R and a duct for discharging an effluent E,
- a duct connected to the duct for drawing off the gaseous phase R from the separator and terminating at a duct for supplying the reforming reactor, for recycling a part of the said gaseous phase R coming from the separator,
- a compression loop comprising at least one compressor disposed on the duct for drawing off the phase R in order to compress to at least 10 bars the gaseous phase emanating from the separator and which is not recycled,
- a duct for feeding the said compressed phase into the duct carrying the effluent E to the recontactor,
- a recontactor provided with a duct for the intake of effluent mixed with the pressurised gaseous phase, a duct for drawing off the reformate and a duct for drawing off the gas,
- a purification unit into which the said gas enters and from which emerges the hydrogen which has a purity greater than 99% and a residual gas,
- a duct for recycling the said residual gas, connecting the purification unit to the duct supplying the compression loop, an intermediate container situated in the purification unit or on the duct through which the residual gas emerges from the said unit.

The method and the plant are described with reference to FIG. 2.

DETAILED DESCRIPTION OF FIG. 2

The product P containing the (essentially aromatic) hydrocarbons and the hydrogen, in the same way as in FIG. 1, enters the separator 1 via a duct 20 and is separated into a hydrogen rich gaseous phase R (duct 21) and a liquid effluent duct (22). Flash separation is usually employed. A part of the low pressure gaseous phase R is recycled via the duct 23 to the reforming reactor(s).

The other part of R is directed (duct 24) into a compression loop comprising at least one compressor 3, a storage vessel 2 upstream of the compressor. Shown here (without this illustration restricting the invention) are two compression stages with one inter-stage vessel 11.

A part of the phase which is compressed to at least 10 bars and generally between 10 to 50 bars and preferably between 20 and 30 bars is introduced (duct 26) into the duct through which effluent enters the recontactor 4. In the same way as in the prior art, the liquid emanating from the vessel 11 is recycled via the duct 25.

The biphase mixture of effluent and compressed phase is fed into the absorber 4.

The absorber (or contactor) 4 preferably functions at between 20° and 60° C. and at pressure of at least 10 bars and generally 10 to 50 bars and preferably between 20 and 30 bars. Conventional exchange of heat in a conventional exchanger 30 is then sufficient to lower the temperature of the biphase mixture entering the exchanger to nearly 70° C. From the absorber 4 emerge the reformate containing the aromatic hydrocarbons (duct 27) and the hydrogen rich gas G (duct 28). The gas G now has a hydrogen purity of at most 95% and generally of between 82 and 87%. The hydrogen purity of this gas G is sufficient for hydroprocessing, also a part of this gas leaves via the duct 29 and passes to the said hydroprocessing unit.

The passage of this G into the purification unit 5 makes it possible to obtain very pure hydrogen (99% at least and generally 99.9%) and a residual gas GR.

In contrast to the prior art, this residual gas is not rejected in its entirety but a part (at least 50% and more generally 90 to 95% of the gaseous volume) is recycled through a valve 7 and a duct 31 and passes to the compression loop and more precisely via the storage vessel 2.

Recycling is carried out under a substantially constant pressure, that is to say the residual gas pressure is levelled out to arrive at a fluctuation in pressure (of the gas entering the compression loop) of not more than ±0.2 bars. One means of obtaining this result is to provide an intermediate container 6 either in the purification unit 5 or on the residual gas outlet duct 33.

The other part of the residual gas is purged (rejected) in order to avoid the accumulation of impurities in the compression loop (duct 32).

By using the recycling of residual gas which may furthermore be combined with modified absorption conditions and by the use of a high capacity compressor (centrifugal compressor), it is possible to:

increase the output of very pure hydrogen by nearly 15%, avoid investment into a refrigerating system and exchangers with the altered absorption conditions, while maintaining as good a degree of separation as possible and therefore a similar quality of reformate, reduce the cost of compression thanks to the recycling which makes it possible to obtain one and the same level of compression with a lesser number of compression stages.

Such advantages were not envisaged by a man skilled in the art who had hitherto been unable to recover this residual hydrogen in the light of the foreseeable cost of compression.

Figure 2:
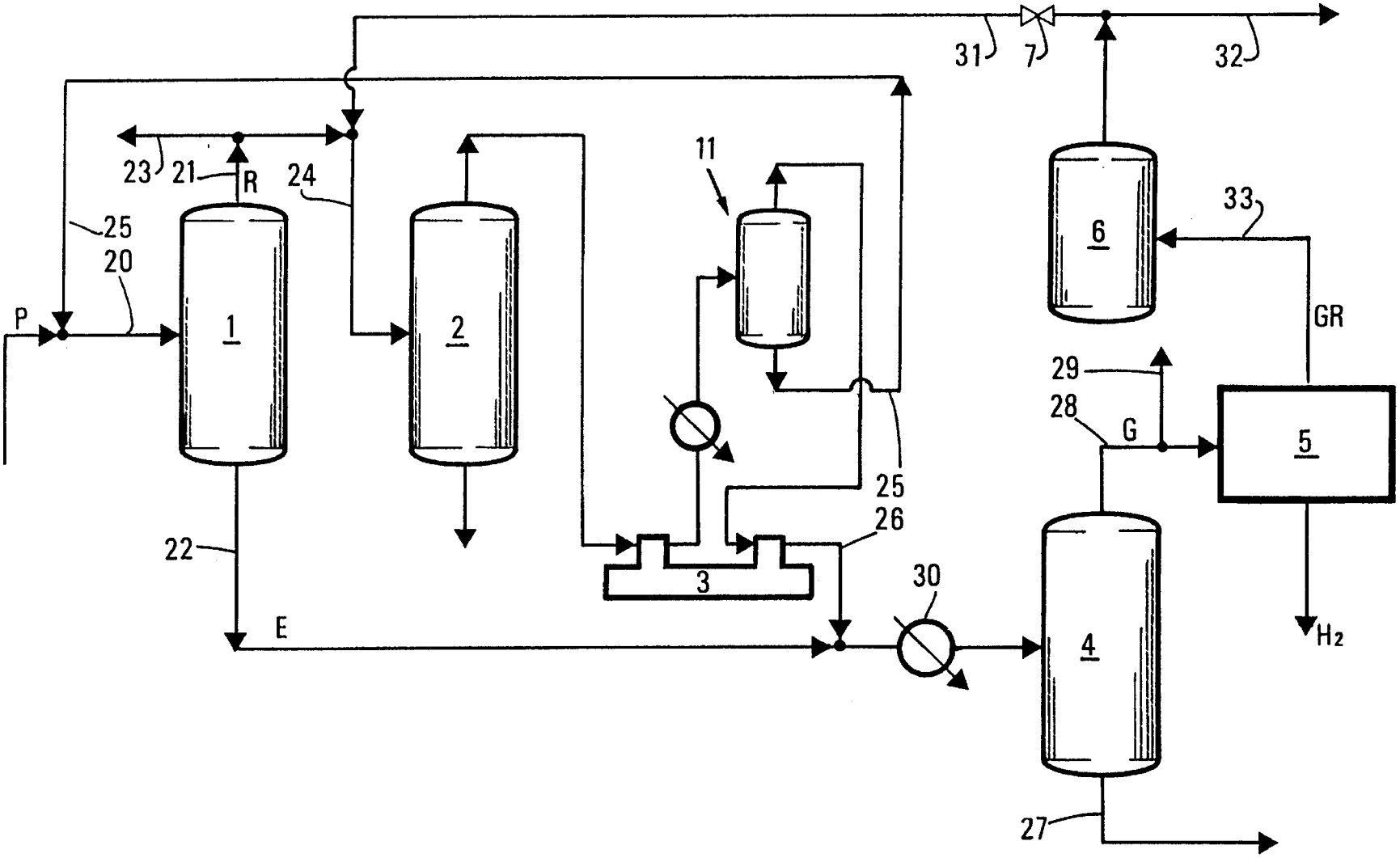
FIG. 2 is a schematic flowsheet of a preferred embodiment of the invention.

In order to illustrate the interest of the invention, a comparison has been made with a conventional process (FIG. 1) and the invention (FIG. 2).

| | FIG. 1 | FIG. 2 |
|---|---|---|
| Working conditions | | |
| Separator P (bars) | 2.3 | 2.3 |
| Recontactor | | |
| P (bars) | 30 | 30 |
| T (°C.) | 0 | 40 |
| Purification unit P (bars) | 2.5/2.9 | 2.5/2.9 |
| Recycling of residual gas (%) | 0 | 90 |
| Performance figures | | |
| *Recovery of $H_2$ (%) | 87.5 | 97.5 |
| **Recovery of LPG (%) | 77.5 | 84.5 |
| Recovery C5+ (%) | unaltered | |

*Recovery = quantity of high purity $H_2$ plus quantity of $H_2$ directed to upstream hydroprocessing/$H_2$ production by reforming

**LPG recovery = quantity C3/C4 in the reformate emanating from the recontactor (production C3/C4 by reforming)

We claim:

1. A plant for processing a reformate withdrawn from a reforming reactor for reforming a hydrocarbon charge, said plant comprising:

a separator 1 provided with an inlet duct 20 for product withdrawn from the reforming reactor, a duct 21 for withdrawing a hydrogen rich gaseous phase R, and a duct 22 for discharging an effluent E, a duct 23 connected to the duct for withdrawing the gaseous phase R from the separator and terminating at a duct for supplying the reforming reactor, for recycling a part of the said gaseous phase R withdrawn from the separator, a compression loop comprising at least one compressor 3 integrated with the duct for withdrawing the phase R for compressing to at least 10 bars the gaseous phase withdrawn from the separator and which is not recycled, a duct 26 for feeding resultant non-recycled compressed gaseous phase into the duct 22 carrying the effluent E to a recontactor 4, said recontactor 4 being provided with a duct 27 for the intake of effluent mixed with the compressed gaseous phase, a duct 34 for withdrawing the reformate, and a duct 28 for withdrawing the gas, a purification unit 5 having an intake duct for said gas withdrawn from the recontactor, an outlet duct 32 for hydrogen having a purity greater than 99%, and an outlet duct for a residual gas, a duct 33 for passing the residual gas to an intermediate container 6, and a duct 31 for recycling said residual gas, connecting the intermediate container 5 to a duct 24 communicating with the compression loop.

2. A plant according to claim 1, further comprising a storage vessel 2 in the compression loop, connecting compressor 3 with the duct 24.

* * * * *